US005107984A

United States Patent [19]

Welschoff

[11] Patent Number: 5,107,984

[45] Date of Patent: Apr. 28, 1992

[54] COSMETIC CASE

[75] Inventor: Heinz Welschoff, Fort Lauderdale, Fla.

[73] Assignee: Heinz Industries, Inc., Coral Springs, Fla.

[21] Appl. No.: 123,298

[22] Filed: Nov. 20, 1987

[51] Int. Cl.[5] ..... B65D 5/50

[52] U.S. Cl. ..... 206/45.13; 206/45.19; 206/235; 206/581; 206/823; 132/295; 132/297; 132/315; 132/318

[58] Field of Search ..... 206/45.13, 45.15, 45.19, 206/229, 230, 235, 581, 823; 132/79 A, 79 C, 79 F, 82 A, 82 D, DIG. 3; 220/DIG. 26

[56] References Cited

U.S. PATENT DOCUMENTS

| | | | |
|---|---|---|---|
| 1,931,079 | 10/1933 | Mitchell | 132/79 C |
| 2,179,669 | 11/1939 | Parkin | 220/DIG. 26 |
| 2,195,593 | 4/1940 | Kreisler | 220/DIG. 26 |
| 2,230,202 | 1/1941 | Machin et al. | 220/DIG. 26 |
| 3,765,528 | 10/1973 | Parisot | 206/45.13 |
| 4,337,859 | 7/1972 | Murphy et al. | 206/823 |
| 4,579,133 | 4/1986 | Seidler | 132/79 A |
| 4,685,558 | 7/1987 | Filiz et al. | 206/235 |

FOREIGN PATENT DOCUMENTS

| | | | |
|---|---|---|---|
| 1951217 | 4/1921 | Fed. Rep. of Germany | 206/37 |
| 2156784 | 10/1985 | United Kingdom | 206/823 |

OTHER PUBLICATIONS

Plastics, Jun. 16, 1966, Chapter 1 "Selecting Plastics" by Glayden V. Fox, pp. 4–7.

*Primary Examiner*—David T. Fidei
*Attorney, Agent, or Firm*—Joseph Zallen

[57] ABSTRACT

A cosmetic case which substantially reduces soiling, has a cover hingedly connected to a base and closed with a locking member. A holder for cosmetic applicators is attached to the base and has a resilient, normally angular pocket for receiving and storing the application end of the applicator, with only the handle exposed. The holder is compressed when the case is closed. A light touch on the locking member permits the holder to push the cover open.

A cosmetic applicator which substantially reduces soiling and which can be carried in a handbag, consists of a sliding sleeve attached to a body having a handle end and an application end.

6 Claims, 4 Drawing Sheets

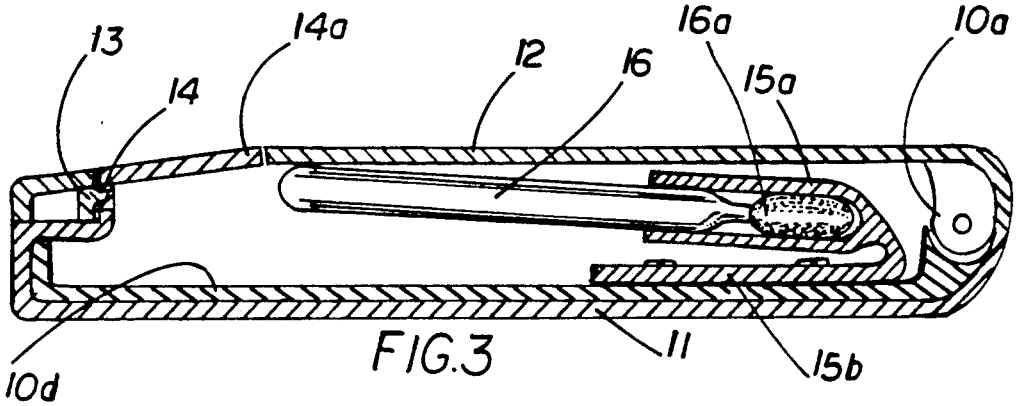
FIG.3
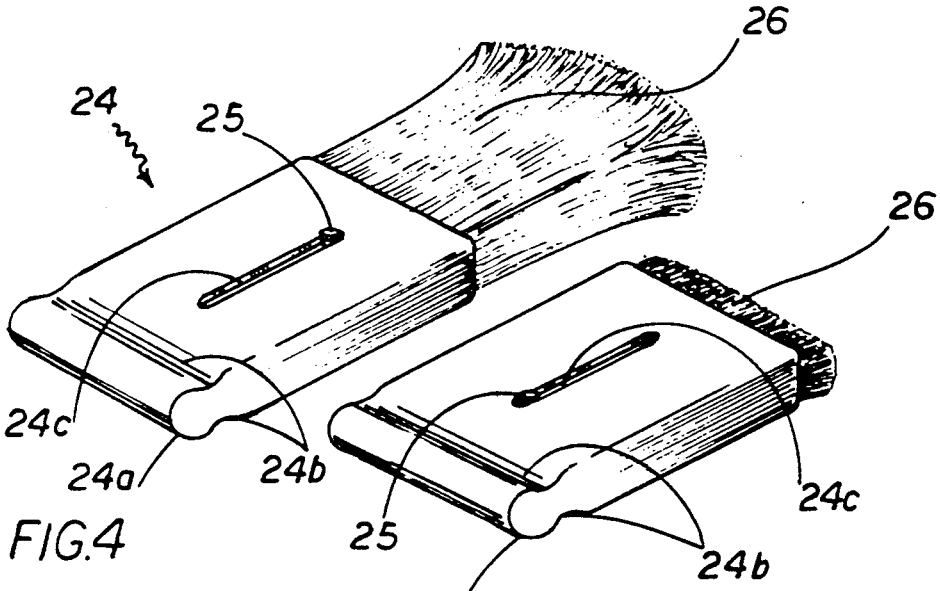
FIG.4
FIG.5
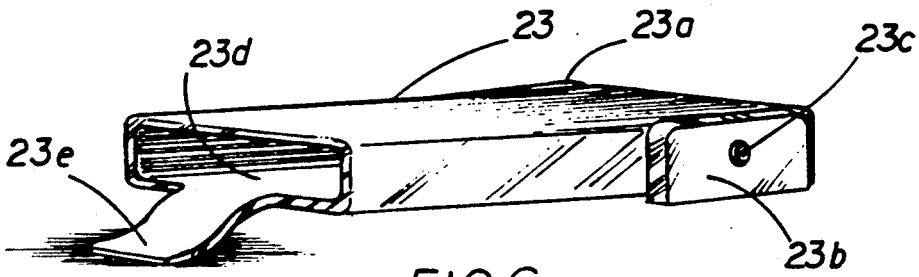
FIG.6

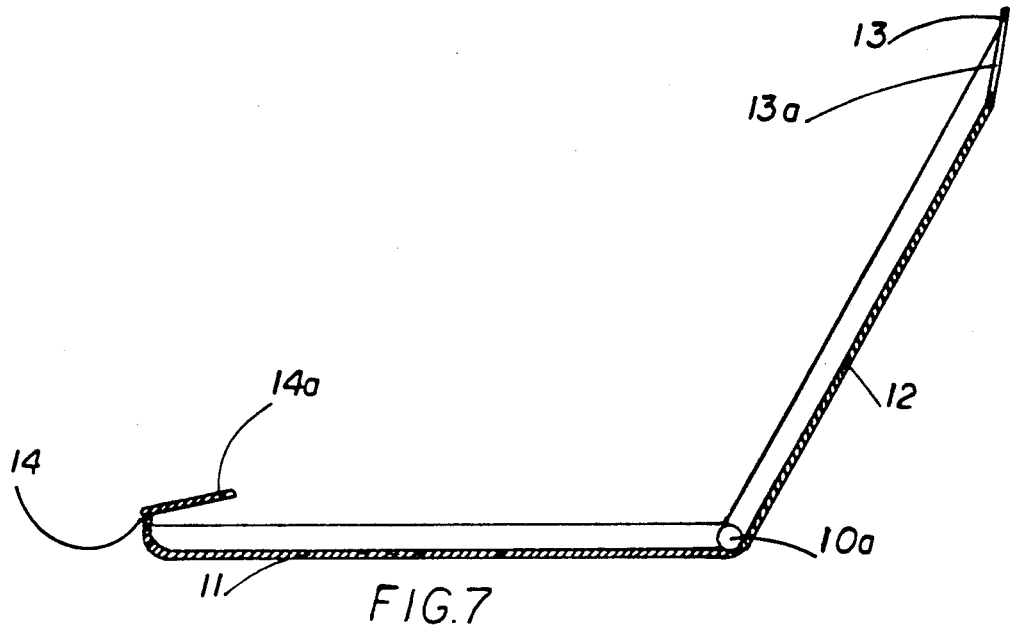
FIG.7
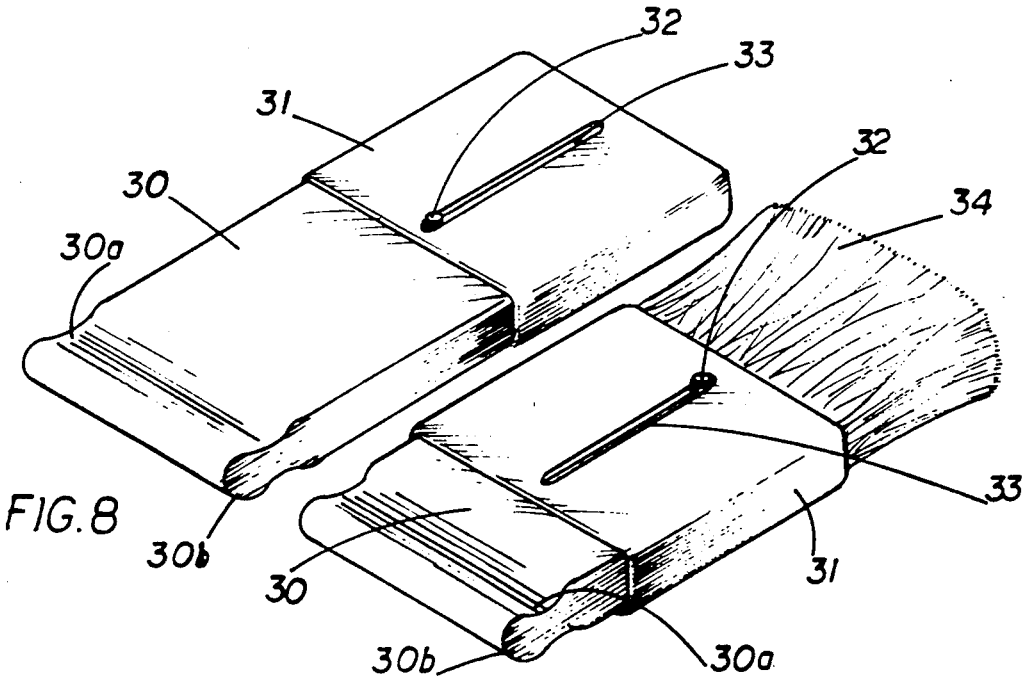
FIG.8
FIG.9

COSMETIC CASE

BACKGROUND OF INVENTION

This invention relates to a cosmetic case and in particular to a case for holding various cosmetic implements such as applicators for eye liner, rouge, lipstick, or the like. It also relates to improved cosmetic applicators.

A common problem in the handling of a cosmetic applicator is the difficulty in preventing the applied material from soiling the hands or fingers of the user. Further, commonly available cosmetic cases themselves become soiled with use so as to make it very difficult for the user to manipulate the contents of the case without getting her hands or fingers soiled.

One object of the present invention is to provide a cosmetic case which will permit clean storage of cosmetic applicators.

Another object of this invention is to provide such a case which will enable the user to keep her hands and fingers clean.

Further objects and advantages of this invention will be apparent from the description and claims which follow, taken together with the appended drawings.

SUMMARY OF INVENTION

The cosmetic case of this invention comprises broadly a base, a cover hingedly connected to the base and means for securing the front of the cover to the base. An important feature of this invention is the provision of novel resilient applicator holders which are mounted on the base. The applicator holders are characterized in having an upper portion which is open at one end. This upper portion is resilient and normally at an angle. When the means securing the cover to case is lightly pressed, to release it, the upper portion moves upwardly causing the cover to spring open. When the case is closed the upper portion is bent down in compressed condition. Cosmetic applicators, which typically have a handle portion and an application portion, are used or stored by having the application end housed within the open upper portion of the resilient holder with only the handle exposed. This substantially reduces soiling. The novel cosmetic applicators of this invention employ sliding sleeves so that the individual applicators can be used and carried outside the case, as, for example, in a woman's handbag, without soiling.

BRIEF DESCRIPTION OF DRAWINGS

FIG. 3 is a transverse cross-section of FIG. 1.

FIG. 4 is a perspective view of a brush which can be housed in the cosmetic case.

FIG. 5 is a view of the brush of FIG. 4 retracted into the handle.

FIG. 6 is a view of the brush holder which is built into the cosmetic case.

FIG. 7 is a cross-section of the outer portion of the cosmetic case in open position.

FIG. 8 is a perspective view of a cosmetic applicator, namely a brush, which can be used and stored in a woman's handbag without soiling.

FIG. 9 is a view of the brush of FIG. 8 with the bristles exposed.

SPECIFIC EXAMPLE OF INVENTION

Figure 1:
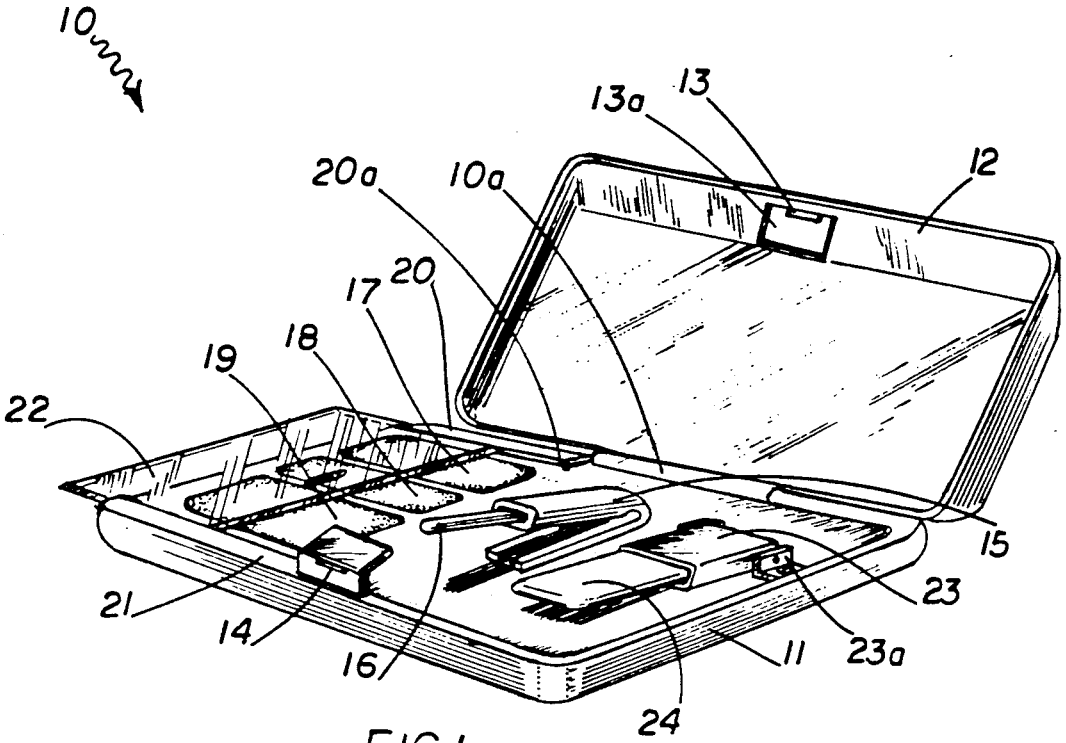
FIG. 1 is a view of one embodiment of this invention with the lid up showing the various components of the cosmetic case.
Figure 2:
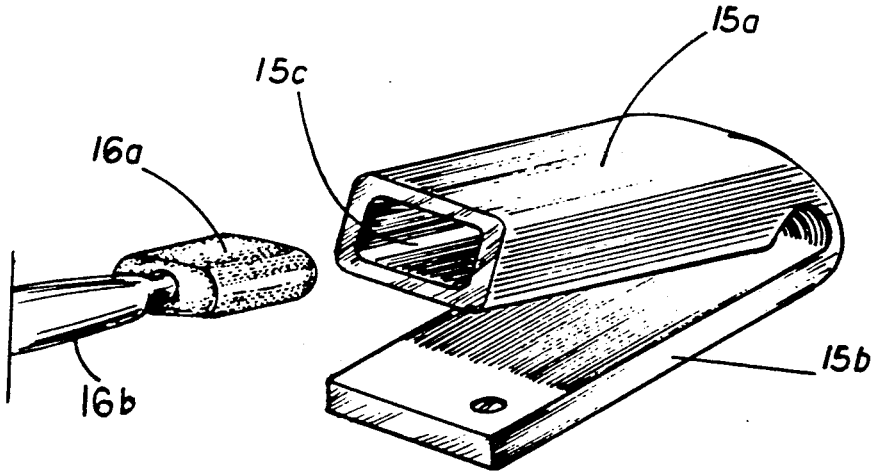
FIG. 2 is an enlarged view of a portion of the case showing a cosmetic applicator withdrawn from its housing.

The cosmetic case illustrated in the drawings comprises a base 11, a tray 10*d* on the base and a cover 12 connected to the tray 10*d* by hinge 10*a*. Base 11 has a locking member 14*a* with a slot 14. Locking member 14*a* is registrable with an aperture 13*a* in the cover 12 and adjacent slot 14 is registrable with protrusion 13 extending into aperture 13*a* in cover 12. The base and cover are preferably made of a flexible material such as plastic.

Tray 10*d* holds the various portions of the cosmetic case, namely open, pivotable brush holder 23, resilient applicator holder 15, and wells 17, 18, and 19 for holding cosmetic materials. A brush 24 is insertable into the brush holder 23 so that only the brush handle is exposed.

Applicator holder 23 is characterized as being pivotally mounted through pivot 23*c* on supports 23*a* and 23*b*. At its open end 23*d* is a downwardly directed resilient finger 23*e*. When the brush is inserted into the holder the top portion 12 of the case, when closed, pushes the finger downward, but when the case is open the finger arches upwardly so that the brush is more easily removable being an angled position.

In a similar manner the applicator holder 15 with its receiving opening 15*c* is angularly and resiliently connected to a base 15*b* which in turn is attached to the cosmetic case. When a cosmetic applicator 16 is inserted into the applicator holder 15 the application end 16*a* is concealed and only the applicator handle 16*b* is exposed. When the upper portion of the case 12 is locked to the bottom portion 11 the holding portion 15*a* is pressed down, but when the cover 12 is reopened the applicator holder 15*a* springs upwardly so as to be at an angle to permit ready, clean insertion or removal of the applicator. The resilience of holders 15 and 23 is such that when the case is closed a light finger touch on locking member is sufficient to cause the cover 12 to pop open.

This automatic angular orientation of brushes and applicators greatly improves the ability of the user to grasp the clean handles of the brush or applicator and avoid dirtying the fingers with materials on the brush or applicator.

The cosmetic wells 17, 18 and 19 are preferably positioned so as to be covered by a sliding, preferably transparent, cover 22 sliding in rails 20 and 21 in conjunction with end stop 20*a*.

The soil-free brush illustrated in FIGS. 4 and 5 is retractable, having a handle portion 24*a* with gripping crevices 24*b*. The bristles 26 are slidable within the housing by means of an upwardly extending member 25 sliding on slot 24*c*.

The soil-free brush described in FIGS. 8 and 9 is not retractable. Brush 30 has a gripping portion 30*b* and crevices 30*a*, an upstanding rod 32, and bristles 34. A sleeve 31 is provided having a slot 33 which is stopped by rod 32 so that the sleeve can be readily used to cover and uncover the bristles.

Figures 10, 11:
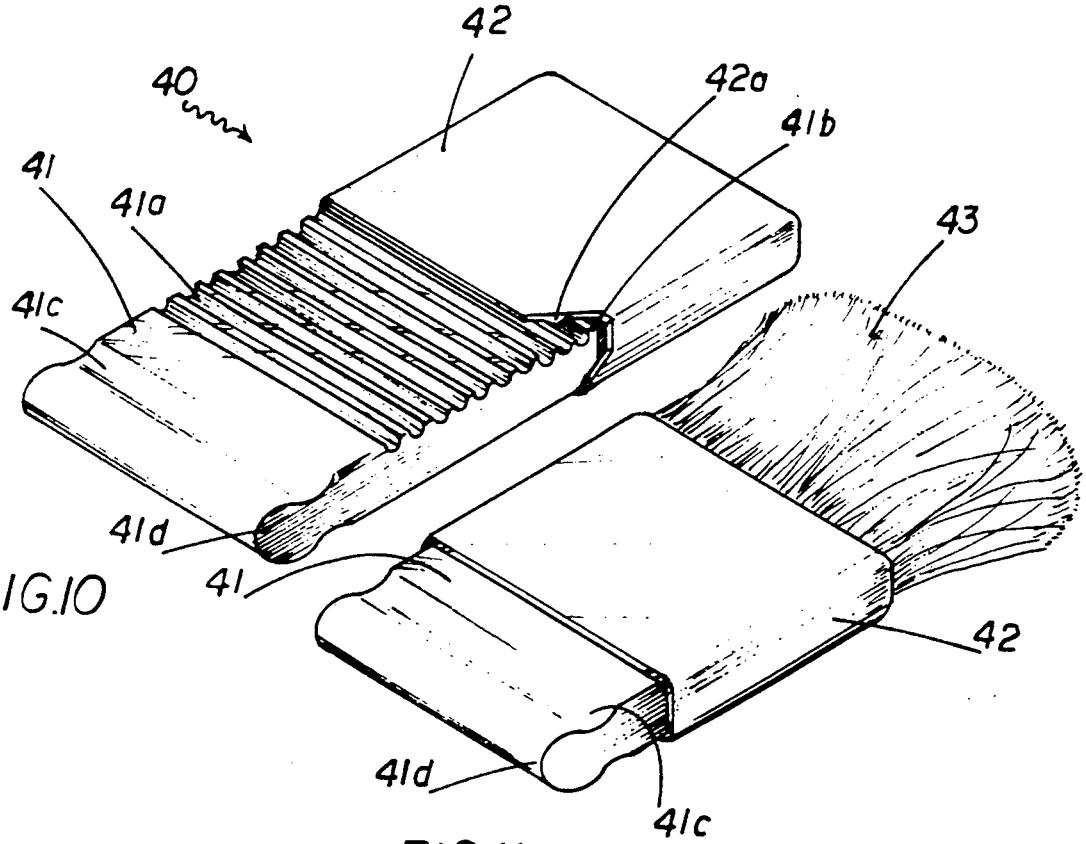
FIG. 10 is yet another embodiment of a soil-free cosmetic applicator, namely a brush.
FIG. 11 is a view of the brush of FIG. 10 with the bristles exposed.

The soil-free brush 40 illustrated in FIGS. 10 and 11 has a handle 41 with a gripping portion 41*d* and a depression 41*c*. The top surface of the brush has transverse grooves 41*a* and bristles 43 at its end. A sleeve 42 is provided having transverse teeth 42*a* registrable with grooves 41*a*. The material of construction is sufficiently flexible so that the sleeve 42 can be readily positioned as to completely cover the bristles or partially so or expose the bristles completely by merely sliding.

Although the soil-free brushes illustrated in the drawings are flat, they can also be circular in cross-section and the grooves 41*a* shown in FIG. 10 can extend around a portion or all of the handle 41.

I claim:

1. A cosmetic case having a cover hingedly connected to a base and means for securing said cover to said base; said base having mounted thereon at least one resilient applicator holder characterized in having an open upper portion for receiving and retaining a cosmetic applicator; said open upper portion being normally in an angular position with reference to the base but being compressed to a substantially flat position when said cover is secured to said base.

2. The cosmetic case of claim 1 in which an applicator having a handle portion and an application portion is positioned in said open end so that only said handle portion is exposed.

3. The cosmetic case of claim 1 in which said base comprises an outer frame and a tray positioned within said frame; said applicator holder being mounted on said tray.

4. The cosmetic case of claim 1 wherein said securing means comprises a flexible locking member registrable with an aperture; said case being characterized in that light pressure on said locking member results in said cover springing open.

5. The cosmetic case of claim 1 wherein said securing means comprises on said base a flexible locking member and an adjacent slot, and on said cover an aperture and protrusion extending into said aperture; said locking member being registrable with said aperture and said protrusion being registrable with said slot; said case being characterized in that light pressure on said locking member results in said cover springing open.

6. A cosmetic applicator having a handle portion and application portion in combination with an applicator holder having a front opening for receiving said application portion; the rear of said holder being angularly and resiliently connected to a support.

* * * * *